US006073298A

United States Patent [19]

O'Brien

[11] Patent Number: 6,073,298

[45] Date of Patent: Jun. 13, 2000

[54] GROUT CLEANING BRUSH

[76] Inventor: Richard E. O'Brien, 603 Racquet Club Rd., #4, Weston, Fla. 33326

[21] Appl. No.: 09/149,787

[22] Filed: Sep. 8, 1998

[51] Int. Cl.[7] ..... A46B 5/00; A46B 9/02

[52] U.S. Cl. ..... 15/160; 15/144.1; 15/172

[58] Field of Search ..... 15/144.1, 144.2, 15/159.1, 160, 172

[56] References Cited

U.S. PATENT DOCUMENTS

| | | | |
|---|---|---|---|
| 2,804,637 | 9/1957 | Antozak | 15/144.1 |
| 3,704,479 | 12/1972 | Whitaker | 15/172 |
| 4,606,091 | 8/1986 | Sartori | 15/160 X |
| 5,319,824 | 6/1994 | Cook, III | 15/144.1 X |
| 5,412,829 | 5/1995 | Hefner | 15/172 X |

FOREIGN PATENT DOCUMENTS

| | | | |
|---|---|---|---|
| 894837 | 10/1953 | Germany | 15/144.1 |

*Primary Examiner*—Mark Spisich
*Attorney, Agent, or Firm*—Joseph N. Breaux

[57] ABSTRACT

A grout cleaning brush comprising a long narrow brush assembly, an elongate handle and a structure for pivotally attaching a lower end of the elongate handle centrally to the long narrow brush assembly. The elongate handle can rotate on the brush assembly to keep the brush assembly level to a floor or wall, as the brush assembly slides back and forth in a grout groove between ceramic tiles during a cleaning operation.

1 Claim, 2 Drawing Sheets

GROUT CLEANING BRUSH

TECHNICAL FIELD

The present invention relates to brush configurations and more particularly to a grout cleaning brush. The grout cleaning brush is a device which contains a single row of stiff bristles attached to a spine. The spine is pivotally connected along a single axis to a handle that allows the spine to pivot with respect to the handle.

BACKGROUND ART

Numerous brush configurations have been provided in prior art. For example, U.S. Pat. No. 3,566,430 to Young; U.S. Pat. No. 4,064,588 to Cooper; U.S. Pat. No. 4,155,142 to Demetriadis; U.S. No. Pat. 4,493,126 to Uy; U. S. Pat. No. D.356,444 to Marshall and U.S. Pat. No. D.375,842 to Gringer all are illustrative of such prior art. While these units may be suitable for the particular purpose to which they address, they would not be as suitable for the purposes of the present invention as heretofore described.

The Young U.S. Pat. No. 3,566,430 discloses a window scraping device. It is a scraping tool for removing snow or ice from vehicle windows and windshields which includes a flat, flexible base provided with a plurality of scraping means arranged on one surface thereof in spaced, substantially parallel rows. The opposite surface of the base preferably includes three spaced handle means arranged to permit the user to flex the base to conform to either a concave or convex surface by selective pressure on certain of the handle means, thereby assuring maximum contact between the scraping means and the surface being scraped.

The Cooper U.S. Pat. No. 4,064,588 discloses a tile grout-cleaning tool. The tool is for manually cleaning the grout between tiles affixed to a wall. The tool has a substantially pear-shaped handle with a large and a small end. A blade is secured in a slot bifurcating the small end having teeth along one edge and protruding from the handle. The teeth are finely and selectively spaced and dimensioned and aligned in a straight line to remove small grout particles when the handle is manually reciprocated. The blade has perforations which are aligned with holes extending through the smaller end of the handle. Screws extend through the holes and perforations from one side of the handle to the other to clamp the blade securely in the slot.

The Demetriadis U.S. Pat. No. 4,155,142 discloses a tile grout scraper tool. It is a traction tool for scraping away excessive grout between the joints of adjacent tile pieces of a floor or wall. The tool is fitted with a handle fixed to a base with a plurality of toothed wheels rotatably fitted in the base to extend below the undersurface of the base, the plane of all wheels lying on a common plane perpendicular to the undersurface of the base. The tool could be used to remove old grout prior to making a freshly grouted joint.

The Uy U.S. Pat. No. 4,493,126 discloses a scraping brush. The scraping brush with the free ends of the bristles has feet or disc shaped terminal members, which provide the latching or anchoring surfaces by which paint scales or other scales are pried or pulled loose when the scraping brush, in which the bristles are attached, is swept over the scales.

The Marshall U.S. Pat. No. D.356,444 discloses a brush. The ornamental design for the brush, as shown and described. FIG. 1 is a front elevational view of the brush showing a new design, the rear being a mirror image; FIG. 2 is a top plan view thereof; FIG. 3 is a side elevational view thereof, the opposite side being a mirror image; and FIG. 4 is a bottom plan view thereof. The handle is shown broken away to indicate indeterminate length.

The Gringer U.S. Pat. No. D.375,842 discloses a small grout brush. The ornamental design for the small grout brush, as shown and described. FIG. 1 is a perspective view of the small grout brush design; FIG. 2 is a front end view of the small grout brush shown in FIG. 1; FIG. 3 is a rear end view of the small grout brush shown in FIG. 1; FIG. 4 is a top view of the small grout brush shown in FIG. 1; FIG. 5 is a side view of the small grout brush shown in FIG. 1, the opposite side being a mirror image thereof; FIG. 6 is a bottom view of the small grout brush shown in FIG. 1; FIG. 7 is a sectional view through section 7—7 of FIG. 5; FIG. 8 is a sectional view through section 8—8 of FIG. 5; and FIG. 9 is a sectional view through section 9—9 of FIG. 5.

GENERAL SUMMARY DISCUSSION OF INVENTION

The grout cleaning brush consists of a long narrow brush assembly approximately fourteen inches long, one-half inch wide and three and one-half inches high with a single row of stiff bristles one-quarter of an inch in thickness running along it's length. The bristles at the ends of the brush assembly are flared out to clean close to walls and baseboards. Low height will allow access under kitchen and bathroom cabinets. A handle similar to a standard broom type handle is attached to the brush assembly by a swivel head joint that allows the handle to swing forward and back over the brush's longitudinal axis, so that it can be pushed back and forth in a grout groove while always remaining level to the floor. The brush assembly is replaceable, allowing the handle and swivel joint to be reused indefinitely. The grout cleaning brush can be manufactures with a shorter handle for use on a tub or shower wall.

A primary object of the present invention is to provide a grout cleaning brush that will overcome the shortcomings of the prior art devices.

Another object is to provide a grout cleaning brush that consists of a brush assembly with a swivel handle, so as to specifically be constructed to clean grout between tiles by keeping the brush assembly level to the floor as the brush assembly slides back and forth in grooves between the tiles.

An additional object is to provide a grout cleaning brush in which the brush assembly consists of a spine with stiff bristles along its length that are flared at the ends, to clean close to walls and baseboards.

A further object is to provide a grout cleaning brush that is simple and easy to use.

A still further object is to provide a grout cleaning brush that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

Similar reference characters denote corresponding features consistently throughout the attached drawings.

EXEMPLARY MODE FOR CARRYING OUT THE INVENTION

Figure 1:
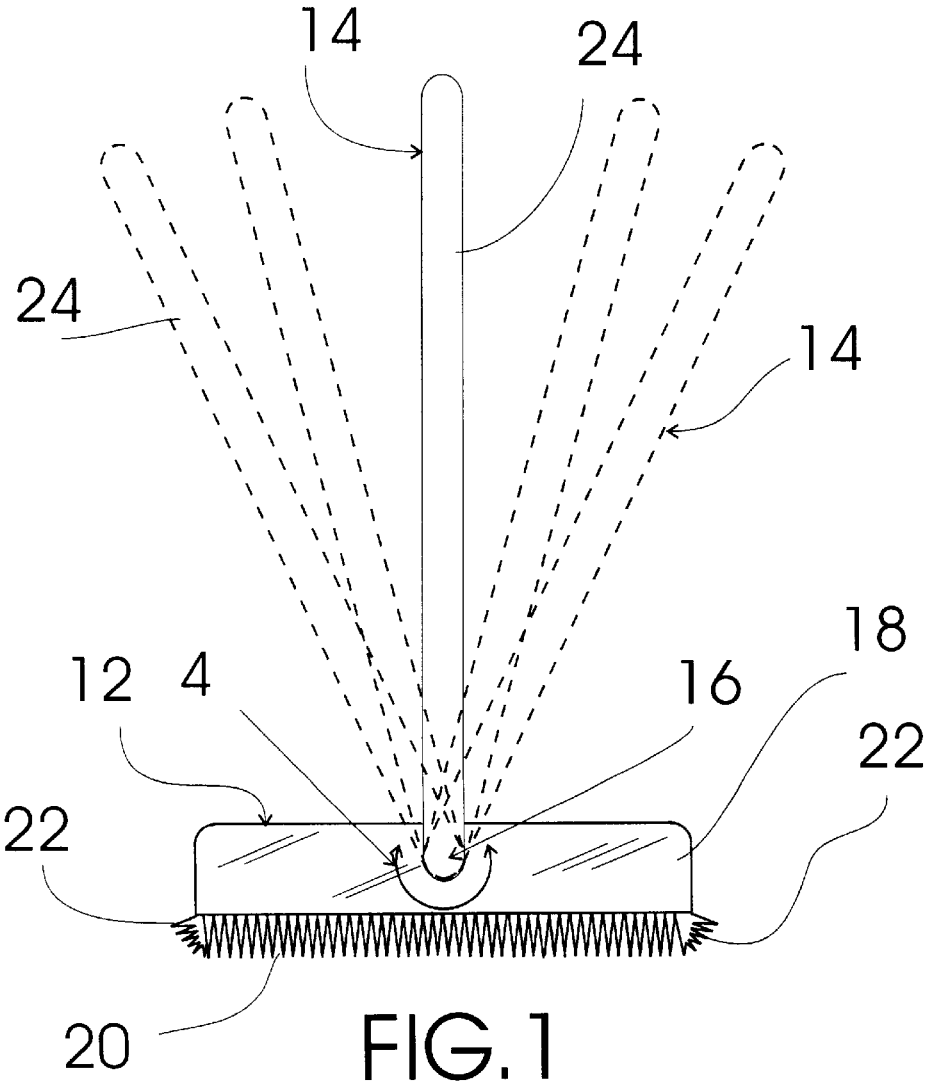
FIG. 1 is a front elevational view of the present invention.

Turning now descriptively to the drawings, in which similar reference characters denote similar elements throughout the several views, FIG. 1 illustrates the various features of the present invention being a grout cleaning brush 10 comprising a long narrow brush assembly 12, an elongate handle 14 and a structure 16 for pivotally attaching a lower end of elongate handle 14 centrally to long narrow brush assembly 12. Elongate handle 14 can rotate on brush assembly 12, to keep brush assembly 12 level to a floor or wall as brush assembly 12 slides back and forth in a grout groove between ceramic tiles during a cleaning operation.

Figure 2:
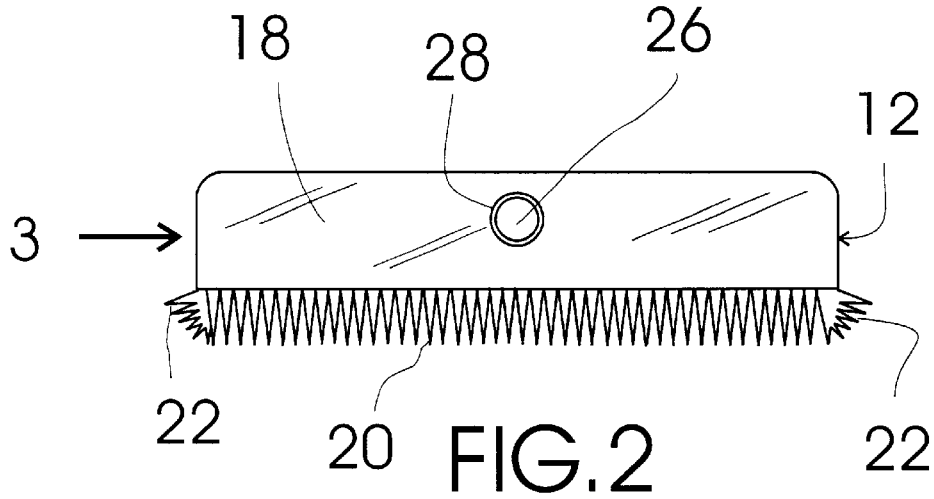
FIG. 2 is an enlarged front elevational view of the long narrow brush assembly.
Figure 3:
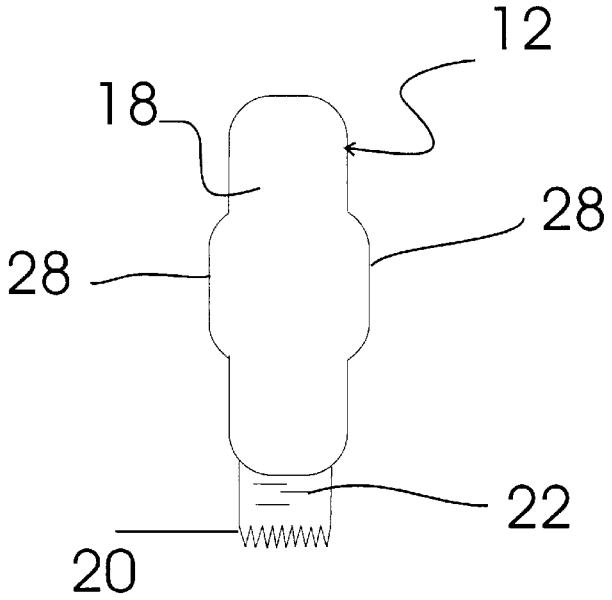
FIG. 3 is a side view taken in the direction of arrow 3 in FIG. 2.

Long narrow brush assembly 12, as best seen in FIGS. 2 and 3, includes a spine 18 and a single row of stiff bristles 20 perpendicularly extending from spine 18. Each end of the single row of stiff bristles 20 is flared outwardly at 22, so as to clean close up, against walls and baseboards. Elongate handle 14 is a thin cylindrical shaft 24 similar to a standard broom type handle.

Figure 4:
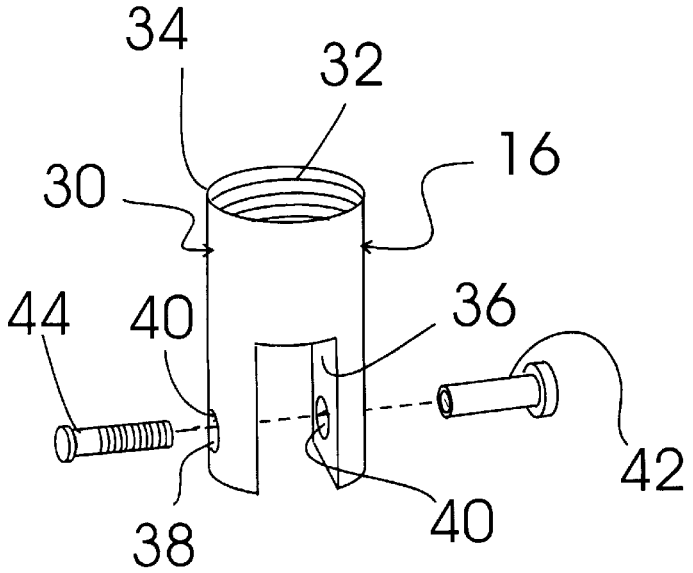
FIG. 4 is an enlarged exploded perspective view of an area of FIG. 1 indicated by arrow 4, showing the swivel head joint and male and female fasteners in greater detail.

Pivotally attaching structure 16 consists of spine 18, having a central transverse hole 26 extending through opposite raised aligned bosses 28. A swivel head joint 30, best seen in FIG. 4, has a receptacle 32 at a first end 34, a slot 36 extending inwardly from a second end 38 and a pair of aligned transverse apertures 40 adjacent second end 38. Lower end of elongate handle 14 can be retained in receptacle 32, while slot 36 at second end 38 of swivel head joint 30 can slip over raised aligned bosses 28. Female fastener 42 fits through one transverse aperture 40 in swivel head joint 30 and into central transverse hole 26 in spine 18. Male fastener 44 fits through other transverse aperture 40 in swivel head joint 30, into central transverse hole 26 in spine 18 and engages with female fastener 42.

It can be seen from the preceding description that in use, a person will simply apply grout cleaning solution to the floor or wall and place the grout cleaning brush 10 into the grout groove. The person will then scrub the grout with a back and forth motion. The unique swivel construction of the elongate handle 14 allows the long narrow brush assembly 12 to move within the grout groove while being pushed back and forth, to remain firmly in contact with the grout. The flared bristles 22 on the ends enables the person to easily clean up against the wall or baseboard, while low overall height allows access under kick area of a cabinet. When used on a bathroom floor, the construction of the grout cleaning brush 10 allows easy access around and behind a toilet and can also be used with a side to side motion to scrub the tile surface. Use of the grout cleaning brush 10 provides a very practical and convenient way to quickly and more easily clean grout on a ceramic floor or wall, saving both effort and man-hours.

It is noted that the embodiment of the grout cleaning brush described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A grout cleaning brush comprising:

a long narrow brush assembly;

an elongate handle; and means for pivotally attaching a lower end of said elongate handle centrally to said long narrow brush assembly, so that said elongate handle can rotate on said brush assembly to keep said brush assembly level to a floor or wall as said brush assembly slides back and forth in a grout groove between ceramic tiles during a cleaning operation;

said long narrow brush assembly including a spine and a single row of stiff bristles perpendicularly extending from said spine;

said pivotally attaching means including said spine having a central transverse hole extending through opposite raised aligned bosses, a swivel head joint having a receptacle at a first end, a slot extending inwardly from a second end and a pair of aligned transverse apertures adjacent said second end, so that a lower end of said elongate handle can be retained in said receptacle, while said slot at said second end of said swivel head joint can slip over said raised aligned bosses, a female fastener to fit through one said transverse aperture in said swivel head joint and into said central transverse hole in said spine, and a male fastener to fit through other said transverse aperture in said swivel head joint, into said central transverse hole in said spine and engage with said female fastener.

* * * * *